US005791957A

United States Patent [19]

De La Cierva, Jr.

[11] Patent Number: 5,791,957

[45] Date of Patent: Aug. 11, 1998

[54] WATER SPORTS DEVICE WITH ELEVATING DISKS

[75] Inventor: Juan De La Cierva, Jr., Avenida de Burgos 40-2A, Madrid, Spain, 28036

[73] Assignees: Juan De La Cierva, Jr.; Samuel Hunter, both of Madrid, Spain

[21] Appl. No.: 781,362

[22] Filed: Jan. 21, 1997

[51] Int. Cl.[6] ..... B63B 1/20

[52] U.S. Cl. ..... 441/65; 441/67

[58] Field of Search ..... 441/65, 67, 79; 114/274

[56] References Cited

U.S. PATENT DOCUMENTS

| | | | |
|---|---|---|---|
| 2,081,868 | 5/1937 | Hampden | 114/274 |
| 3,716,880 | 2/1973 | Sorenson | 441/67 |
| 4,857,026 | 8/1989 | Hull | 441/65 |
| 5,057,044 | 10/1991 | Moore et al. | 441/67 |
| 5,249,998 | 10/1993 | Woolley et al. | 441/65 |

*Primary Examiner*—Sherman Basinger
*Attorney, Agent, or Firm*—J. Sanchelima

[57] ABSTRACT

A water sports device for a standing rider who can turn the device in any direction relative to the towing water craft while at the same time elevating the rider above the surface of the water. This device includes a round board with anchor points on the upper surface for foot bindings as well as a round bar extending downward from the center of the board on which round planning disks are mounted generally at the midpoint and lower end. The rider controls direction and elevation by shifting weight on the board and while the round upper board initially rides on the surface of the water with the planing disks submerged, as the rider increases speed and shifts weight backwards the middle planing disk comes to the surface and ultimately only the lower disk rides on the water. Ideally, towing speed is adjusted so that the riders' weight is comfortably supported with the middle planning disk on the surface of the water while the lower disk remains submerged and the board is elevated.

2 Claims, 3 Drawing Sheets

WATER SPORTS DEVICE WITH ELEVATING DISKS

BACKGROUND OF THE INVENTION

1. Field of the Invention

This invention relates to water sports devices generally and in particular, to water sports devices incorporating multiple round planing surfaces.

2. Description of the Related Art

Many attempts have been made to develop water skis with hydrofoils thereby reducing drag and wave action for the skier. This is accomplished by attaching planing surfaces under a traditional ski board so that these foils lift the board and skier off the water surface thereby eliminating the drag produced by the ski board and changing the source of lift from the water surface to below the surface where disturbances produced by waves are reduced.

Stability and ease of use are two of the most difficult features to accomplish when incorporating hydrofoils to water skis which are inherently less stable than normal water skis as a result of the elevation of the center of mass of the rider from the lifting surfaces. This separation between centers of lift and mass also results in very high control sensitivity of the hydrofoil apparatus to any small shift in rider weight or tow handle position.

One method of reducing this instability is to have the rider sit on the ski board rather than stand thus lowering the center of mass and greatly reducing the riders mobility and ability to shift weight. This method eliminates the use of the riders legs as the main shock absorbing and control interface with the skiing device.

Another method used to further enhance stability is to secure the rider to the board with the use of a lap belt. This further reduces the riders mobility relative to the entire device and prevents the separation of the rider from the apparatus in the event of a fall which can lead to injury.

A further drawback found in existing water ski hydrofoil configurations is the use of flat, vertical or laterally inclined struts which are aligned with the direction of travel to reduce drag and provide directional control. These rudder surfaces do not allow the rotation of the hydrofoil apparatus relative to the direction of travel which eliminates the possibility of turning the hydrofoil sideways or backwards while in the water as is often done with wake boards and trick skis.

As an example, U.S. Pat. Nos. 5,100,354 and 5,249,998 teach the attachment of a hydrofoil apparatus to a ski board on which the rider is seated and secured with a lap belt and foot bindings. A large vertical strut extends below the seat mounted at the rear of the board and two planing surfaces are attached to the ends of an elongated support mounted at the lower end of the strut. Small rudders or fins are mounted below the rear planing surface which extends well behind the rear edge of the board. Under normal operation, the board travels above or on the water surface while the planing blades travel below or at the water surface. In this configuration, the vertical strut, elongated support and rudders as well as the rearward position of the aft planing surface provide directional stability by guiding the apparatus in the longitudinal direction in which it is pointing. Turning the apparatus sideways or backwards produces an immediate change in the direction of travel thus inhibiting the possibility of performing rotational stunts such as having the rider turn his or her side or back towards the tow vehicle. The configuration cited in this reference is also inherently unstable in the vertical axis unless it is used either with the board or planing blades riding on the water surface. Constant attention is required by the rider to altitude above the water in order to maintain the water surface around the middle of the strut. This apparatus will not tend to maintain elevation but will rather allow the board or planing blades to ride on the water surface unless the rider constantly corrects for changes in altitude.

The above considerations suggest the need for a water sport device which can reduce the drag on the skier by using planing surfaces to lift the rider off the surface of the water while at the same time providing the rider maximum safety, stability and freedom of movement. Desirably, a standing rider can use his or her legs for suspension and control while some degree of automatic altitude control would allow the rider to concentrate on performing rotational stunts above the surface of water. Safety would be maintained by allowing the skier to use his or her legs to separate the apparatus from the rider in the event of a fall as with conventional water skies.

SUMMARY OF THE INVENTION

The present invention relates to a water sports device for use by a standing rider who is lifted from the water surface while being towed by a powered water craft. The device includes a support board perfectly round, having an upper surface and a lower surface. Foot straps are secured to the upper surface such that the rider stands at the center of the board. An elongated round bar extends downward from the center of the board. Two planing disks are mounted on the round bar so as to be parallel with the board. One planing disk is mounted at the lower end of the bar while the other planing disk is mounted around the midpoint of the bar at a point which can be determined by the user. The position of the middle planing disk on the bar defines the altitude off the water surface at which the device will tend to balance although the rider can control this altitude by shifting weight forward or backward in the direction of travel.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
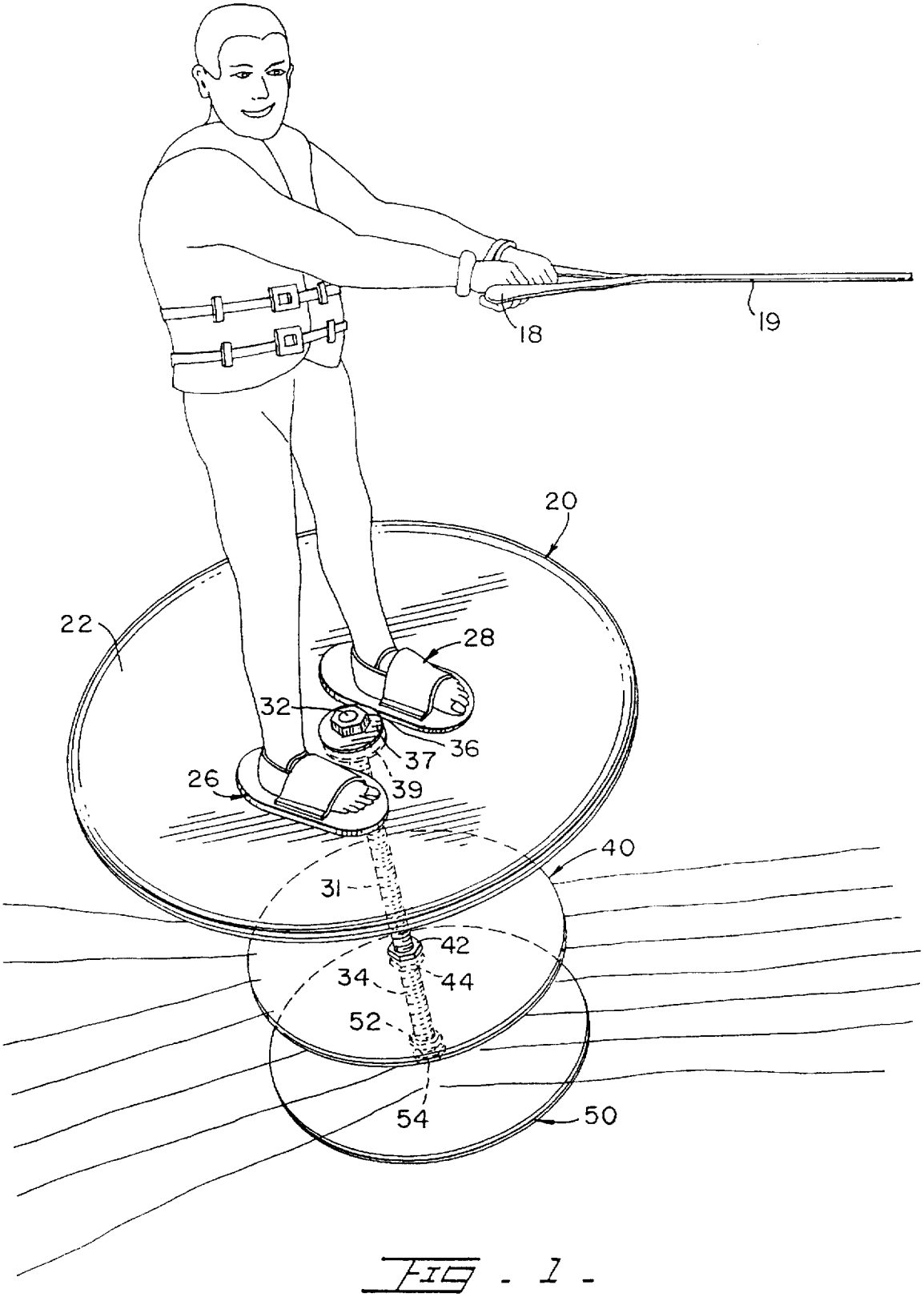
FIG. 1 is a perspective view illustrating a rider being towed by a powered water craft.
Figure 2:
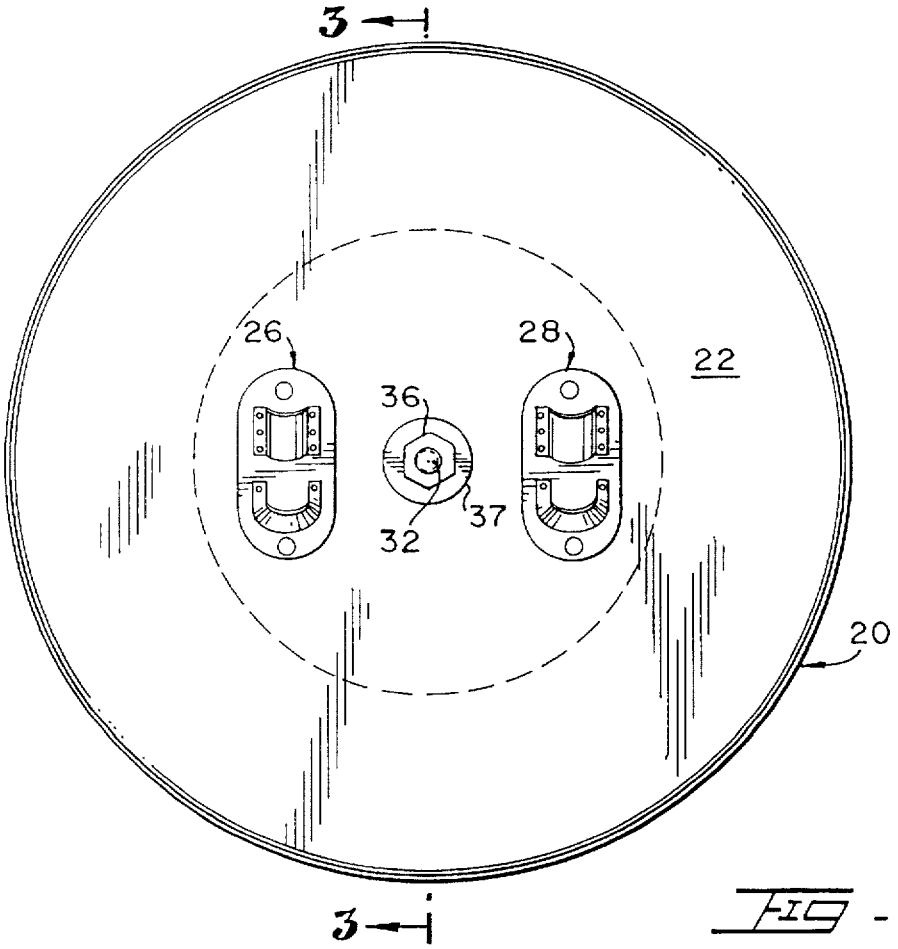
FIG. 2 is a top plan view of the water sports device shown in FIG. 1.
Figure 4:
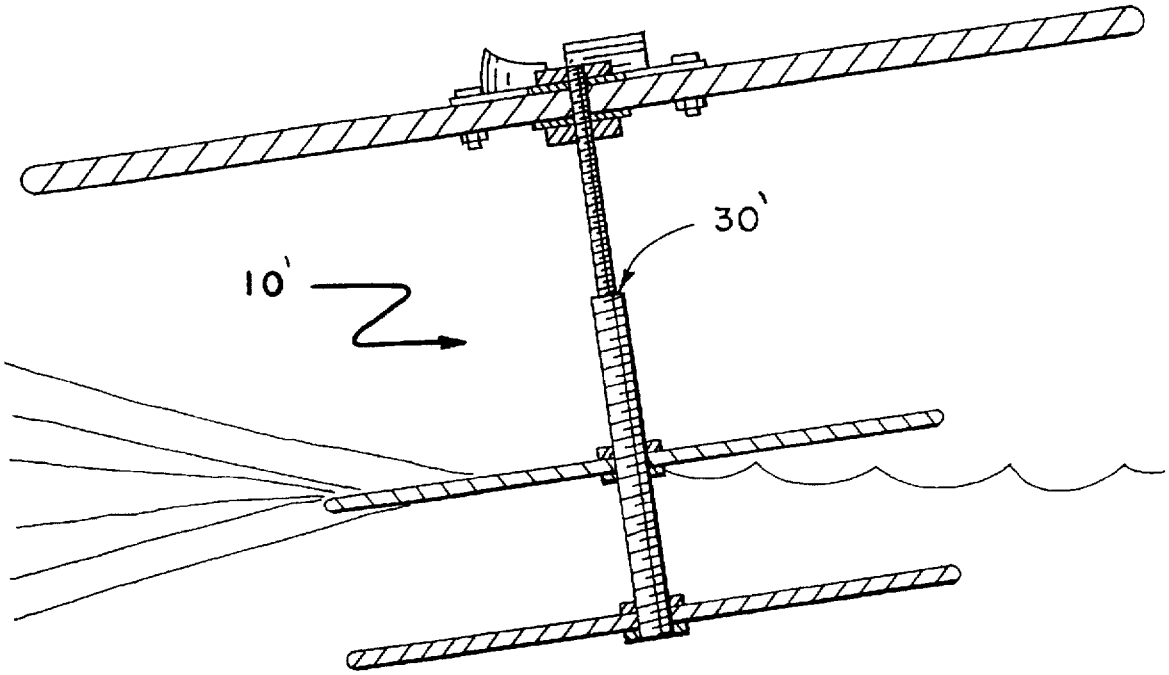
FIG. 4 is an alternative embodiment of the water sports device.

Referring to FIGS. 1 and 2 there is shown a hydrofoil disk 10 being used by standing the rider which embodies the preferred design of the circular water sports device of the present invention. The device includes a round board 20 having an upper surface 22 and a lower surface 24. Foot bindings 26 and 28 are secured to upper surface 22 of board 20 so that the rider stands at the center of board 20. A threaded round bar 30 having an upper end 32 and a lower end 34 extends perpendicular to and down from the center of the lower surface 24 of board 20. Nut 36 and washer 37 are installed at upper end 32 of bar 30 above board 20 while nut 38 and washer 39 are installed on bar 30 just below board 20. A middle planing disk 40 is secured around midpoint 31 of threaded bar 30 by means of nut 42 mounted above planing disk 40 and nut 44 mounted below planing disk 40. The position of disk 40 will depend on the position of nuts 42 and 44 along threaded bar 30. However, there may be other equivalent mechanisms for telescopically adjusting the position of disk 40 with respect to board 20. An alternate embodiment 10' includes the use of telescopic bar assembly 30', as shown in FIG. 4. A lower planing disk 50 is secured at lower end 34 of threaded bar 30 by means of nut 52 mounted above planing disk 50 and nut 54 mounted below planing disk 50. It is an important aspect of the present invention that board 20 and planing disks 40 and 50 be mounted parallel to each other as will be discussed in detail below.

Figure 3:
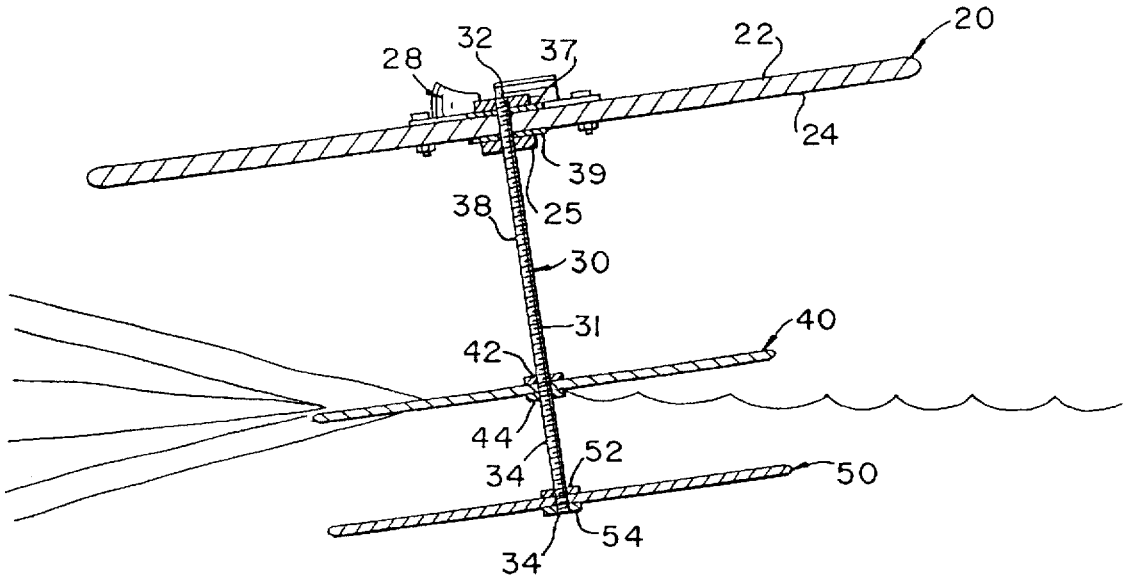
FIG. 3 is an elevational cross-sectional view of this invention, taken along line 3—3 in FIG. 2.

The construction of the device, object of the present invention, will now be described in detail. Referring now to FIGS. 2 and 3, board 20 is preferably made of wood, fiberglass or other plastic composite as is readily known in the art of water skis and wake boards. Board 20 should be disk shaped and approximately 36 inches in diameter while less than one inch thick with a rounded edge on which a rubber guard band may be secured as is often mounted on trick skis. Board 20 is generally flat although some structural form such as greater thickness at the center than at the perimeter may be desirable. Foot bindings 26 and 28 are water ski industry standard items and are secured to board 20 by means of threaded support nut 25 which may also be embedded into board 20 during its manufacture. The centers of bindings 26 and 28 are mounted 12 inches apart so that the rider stands at approximately the center of board 20. The center of board 20 is reinforced with washer 37 at upper surface 22 and washer 39 at lower surface 24 each approximately 6 inches in diameter. These reinforcements may also be embedded into the upper and lower surfaces of board 20. A ¾ inch diameter hole is used to mount threaded bar 30 through the center of board 20. Threaded bar 30 may be ¾ inch in diameter and in the preferred embodiment bar 30 is 16 inches long. Support nuts 36 and 38 should be less than ½ inch thick, about 2 inches in external diameter and should thread on bar 30.

Referring again to FIGS. 2 and 3, planing disks 40 and 50 are made of ¼ inch thick aluminum and in the preferred embodiment, planing disks 40 and 50 should have a diameter of 15 inches. Planing disks 40 and 50 should be flat with rounded edges and a ¾ inch diameter hole in the center for threaded bar 30. Planing disk support nuts 42, 44, 52 and 54 thread on bar 30 and desirably should be less than ¼ inch thick while having at least 2 inches in external diameter. Lower planing disk 50 is mounted at lower end 34 of bar 30 such that the bottom surface of support nut 54 is flush with the flat end of bar 30. Upper planing disk 40 is preferably mounted at the center point 31 of bar 30 as will be discussed below although the user can change the vertical position of planing disk 40 by means of support nuts 42 and 44.

OPERATION

The use of the device object of the present invention and the most important aspects of its various modes of operation will now be described.

Once in or near the water, the rider simply inserts his or her feet into foot bindings 26 and 28 which should be adjusted for a snug fit as with any water ski or wake board. Once again as in the case of normal water skis, the rider grasps the handle 18 of tow rope 19 and once in the water with knees bent, raises the forward edge of board 20 slightly out of the water. The tow boat then starts to pull the skier and due to the very large surface area of board 20, a very small speed will lift the rider out of the water while board 20 rides on the water surface. The device, object of the present invention, can be used in this surface mode at very slow speed (about 8 MPH) in order to give the rider some time to learn the lateral responses of the device by shifting weight from one foot to the other. In this "surface" mode, part of the weight of the rider will be supported by submerged planing disks although control and the responses of the device object of the present invention will be mostly defined by board 20. The rider can also shift weight forward and backward while still in surface mode to experience a preview of the response the device object of the present invention will produce when attempting to lift the rider above the water. Short hops can thus be achieved although only very light riders can maintain board 20 out of the water at such low speed.

As the tow boat increases speed to about trick ski or wake board levels (about 15 MPH), the lift produced by the planing disks become sufficient to lift board 20 and the rider off the surface of the water. This also requires the rider to shift weight backward as maintaining rider weight forward will keep board 20 on the surface of the water. Once the rider shifts enough weight backward to have the planing disks lift board 20 out of the water, the device object of the present invention will rise until upper planing disk 40 rides on the surface at which point the device object of the present invention will achieve its natural point of vertical balance. This "balance" mode is produced when the upper surface of upper planing disk 40 rides over the water surface thus no longer producing lift. The lower surface of the planing disk 40 rides on the water surface thus establishing an equilibrium between the lift produced by the device object of the present invention and the total weight of device and rider. While tow boat speed and rider weight distribution are maintained, the device object of the present invention will tend to stay at its vertical balance point. If altitude increases, upper planing disk 40 will rise off the water thus producing no lift and allowing the altitude to drop. If altitude decreases, upper planing disk 40 will submerge thus increasing its lift by using the upper surface of said planing disk 40 in addition to its lower surface to produce extra lift. In this manner, the device object of present invention will have a natural tendency to balance itself and the rider with the upper planing disk riding on the surface of the water. As in "surface" mode, the rider can force the device to climb or descend by shifting weight backward or forward thus changing the angle of attack that planing disks 40 and 50 use to produce lift. The rider can also shift weight from one foot to the other thus changing the direction of the device and crossing the tow boat wake or riding outside the wake.

The final mode of operation of the water sports device of the present invention is in "High" mode in which lower planing disk 50 rides on the surface of the water while planing disk 40 and board 20 ride completely out of the water. A tow boat speed of about 20 MPH is required for a skier of average weight to reach "High" mode. Control of the device is the same as in "Balance" mode while the response from the device object of the present invention will be more sensitive in the downward direction than in the upward direction as this is the maximum altitude attainable by the device without jumping. Drag will be minimum in this "High" mode as only the lower surface of lower planing disk 50 will ride in contact with the water while the rest of the device rides above water. Balance in both the lateral and longitudinal axis will be more difficult due to the large separation between the center of lift which is at lower planing disk 50 and the center of mass which is approximately at the rider's waist.

Due to the axial symmetry of the water sports device of the present invention and the total absence of rudder surfaces, the rider can rotate his or her body as well as the device relative to the direction of travel and the tow line. The skier can thus ride sideways or backwards on the device object of the present invention as is often done with trick skis or wake boards. Control of the device remains identical regardless of axial orientation as shifting weight from one side to the other or forward and backward will produce identical results.

Thus an improved water sports device is hereby described which can reduce drag on the rider by using planing surfaces to lift the device and rider off the water while at the same time providing maximum safety, natural stability and complete rotational freedom.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A water sports device on which a standing human rider can be towed behind a powered water craft, comprising;

A) a round board having an upper surface and a lower surface and further comprising foot bindings installed on said upper surface of said round board so that the rider stands over the center of said round board;

B) an elongated bar having first and second ends, said first end centrally and perpendicularly mounted to said lower surface;

C) a first planing disk mounted between said first and second ends at a predetermined distance from said board and wherein said elongated bar has a round cross-section with an external threaded surface and further including first and second nut members cooperatively engaged to said elongated bar to sandwich and keep in place said first planing disk; and D) a second planing disk mounted to said second end.

2. The water sports device set forth in claim 1, wherein said elongated bar is telescopically adjustable so that the position of said first planing disk with respect to said board can be varied.

* * * * *